US009797681B2

(12) United States Patent
Szlemko et al.

(10) Patent No.: US 9,797,681 B2
(45) Date of Patent: Oct. 24, 2017

(54) STOWABLE EFFECTOR LAUNCH SYSTEM

(71) Applicant: Raytheon Company, Waltham, MA (US)

(72) Inventors: Emile M. Szlemko, Vail, AZ (US); Brian A. Gin, Tucson, AZ (US); Chad V. Anderson, Tucson, AZ (US); Charles E. Morgan, Jr., Vail, AZ (US); James M. Kurtis, Marana, AZ (US)

(73) Assignee: Raytheon Company, Waltham, MA (US)

( * ) Notice: Subject to any disclaimer, the term of this patent is extended or adjusted under 35 U.S.C. 154(b) by 576 days.

(21) Appl. No.: 14/314,784

(22) Filed: Jun. 25, 2014

(65) Prior Publication Data

US 2015/0377586 A1 Dec. 31, 2015

(51) Int. Cl.
*F41F 3/04* (2006.01)
*F41A 21/20* (2006.01)
*F41F 3/073* (2006.01)

(52) U.S. Cl.
CPC ..... *F41F 3/04* (2013.01); *F41A 21/20* (2013.01); *F41F 3/073* (2013.01)

(58) Field of Classification Search
CPC ..... F41F 3/04
(Continued)

(56) References Cited

U.S. PATENT DOCUMENTS 2,409,210 A * 10/1946 Jolly ..... B64D 1/04 89/1.51
3,800,659 A * 4/1974 Kuiper ..... F41A 23/20 89/1.802
(Continued)

FOREIGN PATENT DOCUMENTS

DE 10235993 A1 12/2009
EP 2053337 A1 4/2009
(Continued)

OTHER PUBLICATIONS

"International Application Serial No. PCT/US2015/027517, International Search Report mailed Jul. 3, 2015", 4 pgs.
(Continued)

*Primary Examiner* — Reginald Tillman, Jr.
(74) *Attorney, Agent, or Firm* — Schwegman Lundberg & Woessner, P.A.

(57) ABSTRACT

An effector launch system includes a stowable effector launcher housing having a housing panel configured for coupling with a vehicle, and one or more receptacle brackets movably coupled with the housing panel. The one or more receptacle brackets include one or more effector launcher sockets. The launch system further includes one or more effector launchers. Each effector launcher includes an effector received within an adapter housing. The stowable effector launcher housing is movable between deployed and stowed configurations. In the deployed configuration the one or more receptacle brackets extend from the housing panel and the one or more effector launchers are received within the one or more effector launcher sockets. In the stowed configuration the one or more effector launchers are removed from the one or more effector launcher sockets and the one or more receptacle brackets are stowed along the housing panel.

30 Claims, 7 Drawing Sheets

(58) Field of Classification Search
USPC ..... 89/1.8, 1.801, 1.802, 1.804, 1.815
See application file for complete search history.

(56) References Cited

U.S. PATENT DOCUMENTS

| | | | | | |
|---|---|---|---|---|---|
| 4,106,389 | A * | 8/1978 | Walley | B64D 7/06 244/118.1 |
| 4,667,565 | A * | 5/1987 | Anderson | F41A 23/20 89/36.08 |
| 7,854,189 | B1 * | 12/2010 | Fox | B63G 1/00 89/1.804 |
| 8,297,166 | B2 | 10/2012 | Onuk | |

FOREIGN PATENT DOCUMENTS

| | | | |
|---|---|---|---|
| EP | 2746715 | A2 | 6/2014 |
| FR | 2987344 | A1 | 8/2013 |
| WO | WO-2005001372 | A2 | 1/2005 |
| WO | WO-2015199802 | A1 | 12/2015 |

OTHER PUBLICATIONS

"International Application Serial No. PCT/US2015/027517, Written Opinion mailed Jul. 3, 2015", 6 pgs.

* cited by examiner

STOWABLE EFFECTOR LAUNCH SYSTEM

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright, Raytheon Company; Waltham, Mass. All Rights Reserved.

TECHNICAL FIELD

This document pertains generally, but not by way of limitation, to effectors and effector launch systems including missiles and missile launch systems.

BACKGROUND

Vehicles, for instance seagoing vessels, may have military or noncombat roles. For example, in the case of a navy, vessels of the fleet provide a platform for weapons and the transport of sailors and vehicles for use around the world. Weapon systems often require significant investments of capital and space on board the vessels. Some weapon systems, such as effector systems (e.g., missile launcher, countermeasure launcher, UAV launcher, flare launcher or the like), are extremely expensive, require maintenance and extensive training, and are only occasionally needed. Accordingly, cost, maintenance and manpower investment often outweigh the infrequent mission specific need for a launcher.

In other examples, vessels are designated for non-combat roles including cargo transport, emergency support, humanitarian aid or the like. Non-combat vessels forego space critical weapon systems in order to better carry out non-combat missions. Where weapons are needed man portable systems, such as small arms or shoulder fired effector systems, are brought on board and used as needed.

Overview

The present inventors have recognized, among other things, that a problem to be solved can include providing the capabilities of effector systems in the limited space of a naval vessel, for instance smaller naval craft. Effector systems (e.g., missile launch systems, countermeasure launchers, UAV launchers or the like), assume significant space on vehicles. Space is at a premium on naval vessels, and especially on smaller naval vessels such as patrol craft, fast attack craft (FAC) and auxiliary ships. Further a variety of effectors (missiles) are often desired to fill differing functions including offensive, defensive and nonlethal functions. However, on smaller vessels the inclusion of multiple effector launchers configured to deliver each of the varying effectors requires significant space and expense.

In an example, the present subject matter can provide a solution to this problem, such as by providing a stowable effector launcher housing. The launcher housing is installed on a vehicle, for instance a naval vessel, and is configurable in a deployed configuration from a stowed configuration. In a deployed configuration the stowable effector launcher housing provides one or more effector launcher sockets configured to receive one or more effector launchers (including an effector and effector adapter). In one example, the effector launchers are slidably received in the one or more effector launcher sockets and the effector launchers are connected by way of an data and power interface with the vessel fire control system. In a stowed configuration, the effector launchers are removed from the effector launcher sockets, and the stowable effector launcher housing is stowed. The stowable effector launcher housing provides a compact framework along a vessel surface (e.g., a hull, deck or cabin roof) configured to deploy one or more effector launchers in a space conscious manner.

Further, the stowable effector launcher housing provides one or more modular effector launcher sockets that are configured to receive a variety of effector types. In one example, the stowable effector launcher housing includes one or more modular effector launcher sockets to facilitate deployment with 2 or more effectors. For instance, two offensive effector launchers, two defensive (missile interception) effector launchers, and one non-lethal effector launcher are received in the stowable effector launcher housing. Operators may freely exchange any of the effector launchers for identical or differing effector launchers according to the needs of a particular mission. The modular nature of the stowable effector launcher allows for a small vessel, such as a patrol craft, to carry and have ready multiple effector types for a variety of functions without needing multiple launching systems that would otherwise take up significant space on board the vessel.

The present inventors have recognized, among other things, that another problem to be solved can include providing the capability of effector systems in a naval vessel while also facilitating use of the space otherwise designated for effector systems in non-combat roles where effectors are not needed. For instance, vessels with dedicated effector systems include housings, electronics, structural framework and the like to couple and operate the effector systems on board the vessel. In non-combat functions, for instance during cargo or passenger transport, humanitarian aid delivery or the like, the space used for such effectors is not repurposed unless painstaking effort is made to physically remove the effector launcher including structural framework.

In an example, the present subject matter can provide a solution to this problem, such as by providing a stowable effector launcher housing. As described herein, the stowable effector launcher housing is installed on a vehicle and is configurable in a deployed configuration from a stowed configuration. In a deployed configuration the stowable effector launcher housing provides one or more effector launcher sockets configured to receive one or more effector launchers (including an effector and effector adapter). In a stowed configuration, the effector launchers are removed from the effector launcher sockets and the stowable effector launcher housing is broken down. For instance, one or more receptacle brackets are stored along a housing panel of the launcher housing. Stowing of the launcher housing collapses the effector launcher sockets, and the launcher housing thereafter assumes a minimal profile on the vessel and frees space for non-combat functions. Accordingly, the stowable effector launcher housing ensures even small vessels, such as patrol craft and FAC, can benefit from the capabilities of a variety of effector launchers while at the same time ensuring that such systems are readily removed and the stowable effector launcher housing is stowed to make room for other non-combat functions.

This overview is intended to provide an overview of subject matter of the present patent application. It is not intended to provide an exclusive or exhaustive explanation of the disclosure. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
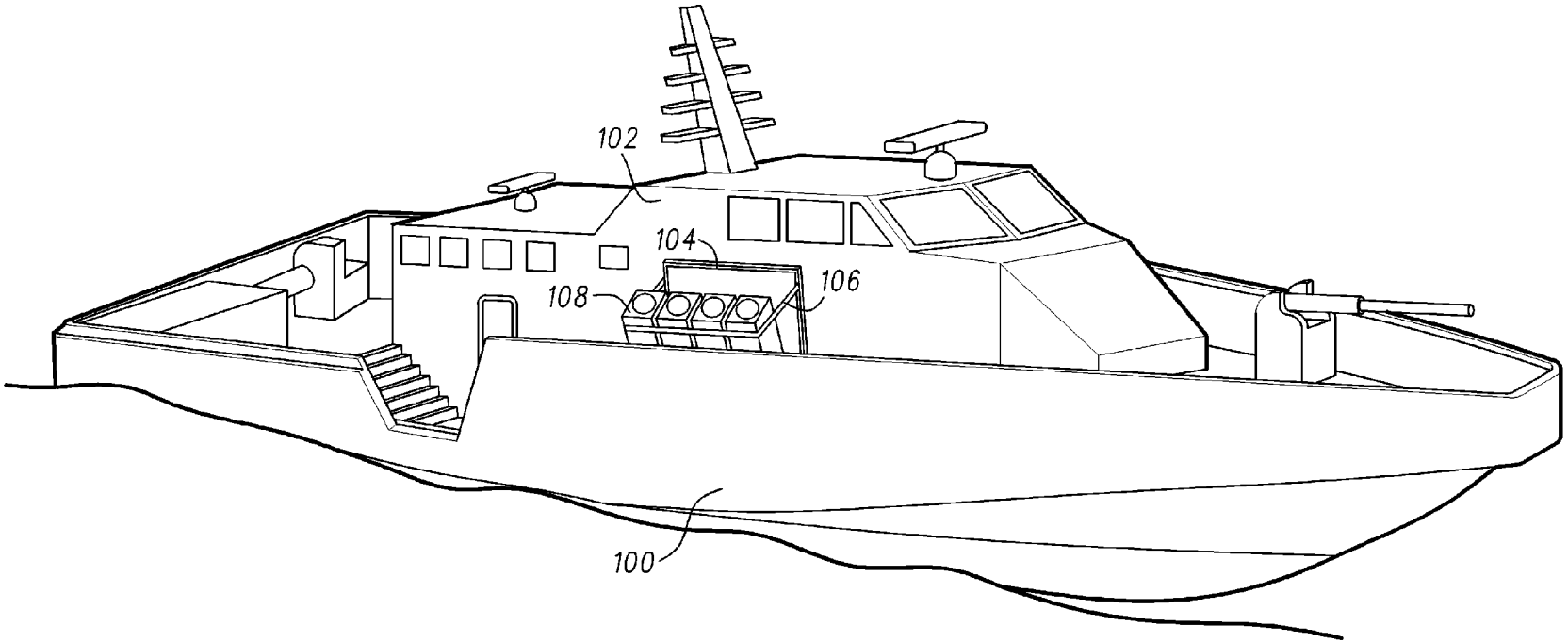
FIG. 1 is a schematic view of a vehicle including one example of an effector launch system having a stowable effector launcher housing in a deployed configuration.

FIG. 1 shows one example of a vehicle 100 including an effector launch system 104 coupled with a vehicle surface 102. As shown in FIG. 1, the vehicle 100 includes a boat such as a fast attack craft (FAC), patrol boat or other marine vehicle. In another example the vehicle 100 includes ground based or air based vehicles (e.g., cars, tanks, armored personnel carriers, hovercraft, helicopters, planes and the like). In the example shown in FIG. 1 the vehicle 100 includes the vehicle surface 102 (whether horizontal or vertical or angled) with the effector launch system 104 mounted thereon. As will be described herein the effector launch system 104 is positioned between deployed and stowed configurations. The deployed configuration is shown in FIG. 1 with the plurality of effector launchers 108 provided in one or more effector launcher sockets of the effector launcher housing 106. In the stowed configuration (shown in FIG. 2) the effector launchers 108 are removed from the effector launcher housing 106 and the launcher housing is stowed, for instance along the vehicle surface 102, thereby opening the space otherwise occupied by the effector launchers 108.

Referring again to FIG. 1, the effector launcher housing 106 is shown coupled along the vehicle surface 102. In one example the vehicle surface 102 is a portion of the vehicle 100 having a planar or substantially planar or continuous configuration capable of receiving the effector launcher housing 106. Optionally, the effector launcher housing is modified (e.g., with mounting brackets or the like) to couple along non-planar or discontinuous surfaces. As shown in FIG. 1 the vehicle surface 102 is provided in a vertical orientation. In another example the effector launcher housing 106 is mounted on a horizontal or angled portion of the vehicle 100 as needed.

As shown, the effector launch system 104 includes a plurality of effector launchers 108 removably positioned within the effector launcher housing 106. As shown in FIG. 1 and described herein the effector launcher housing 106 provides one or more sockets configured to receive the one or more effector launchers 108. The effector launchers 108 are positioned within the effector launcher housing when deployment of the effector launchers 108 is desired or anticipated. When the space on the vehicle 100 is needed or the effector launchers 108 are not needed based on mission parameters the effector launchers 108 may be removed from the effector launcher housing 106 and the launcher housing moved into the stowed configuration (see FIG. 2) wherein the effector launcher housing 106 is stowed along the vehicle surface 102 thereby opening space on the vehicle (e.g., for the storage of equipment, personnel transport, humanitarian aid transport or the like).

As described herein the effector launcher 108 includes but is not limited to an adapter housing for instance a launching system including an effector therein. The effector includes, but is not limited to, a missile, counter measure device, flare, unmanned air vehicle (UAV) or the like. Stated another way, the effector launcher 108 is not limited to a missile launcher. In another example, the effector launcher housing 106 is configured to receive a plurality of differing effector launchers 108 as described herein. For instance, one or more missile effector launchers are provided in the effector launcher housing 106, and at the same time a flare effector launcher, and a UAV or counter measures effector launcher 108 is also provided in the same effector launcher housing 106. The variable selection of effector launchers 108 provides flexibility and accordingly broadens the capability of the vehicle 100 for differing missions.

Figure 2:
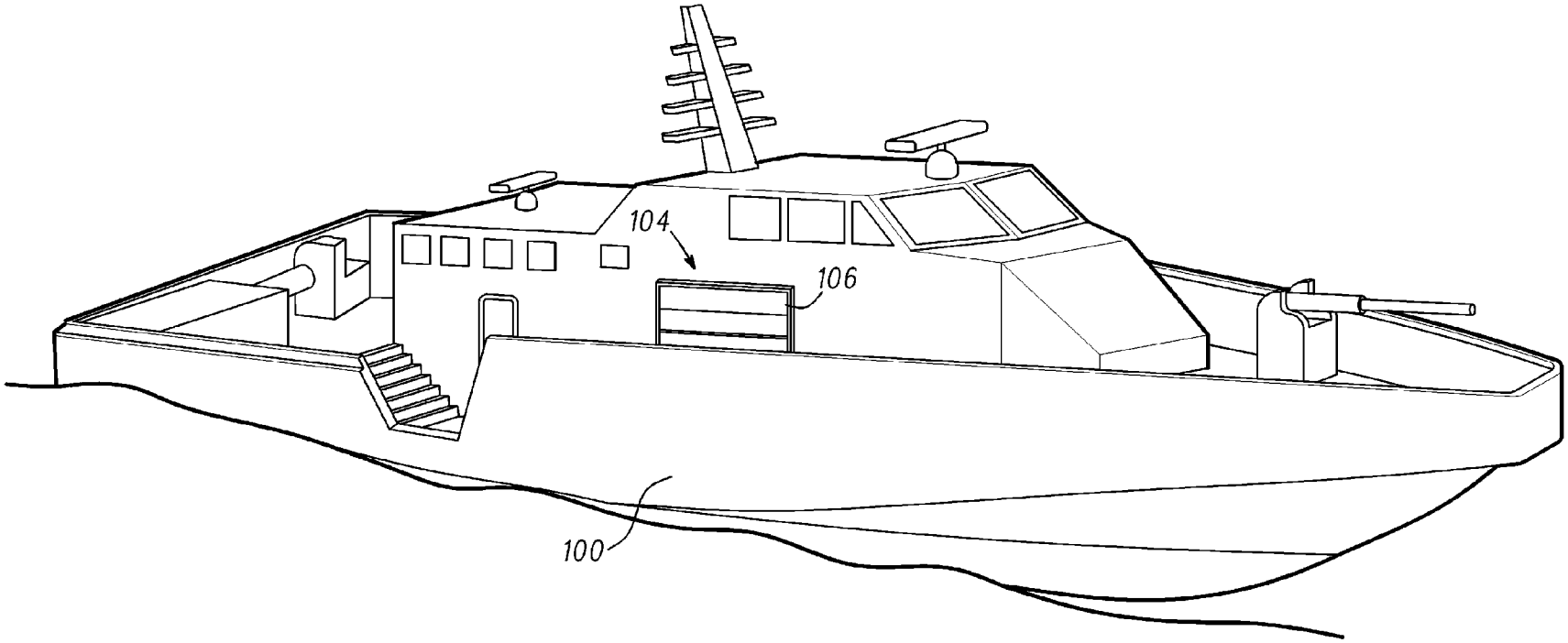
FIG. 2 is a schematic view of the vehicle including the effector launch system of FIG. 1 in a stowed configuration.

FIG. 2 shows the effector launcher housing 106 in the stowed configuration. As shown the effector launcher housing 106 has the effector launchers 108 removed and the brackets are collapsed (e.g., rotated, folded or the like) into the stowed configuration. Accordingly the effector launcher housing 106 is in a collapsed configuration extending along the vehicle surface 102 to thereby open up the space otherwise occupied by the effector launchers 108. In one example the effector launchers 108 are removed from the vehicle 100 entirely or stowed for instance within a storage compartment within the vehicle 100.

Figure 3:
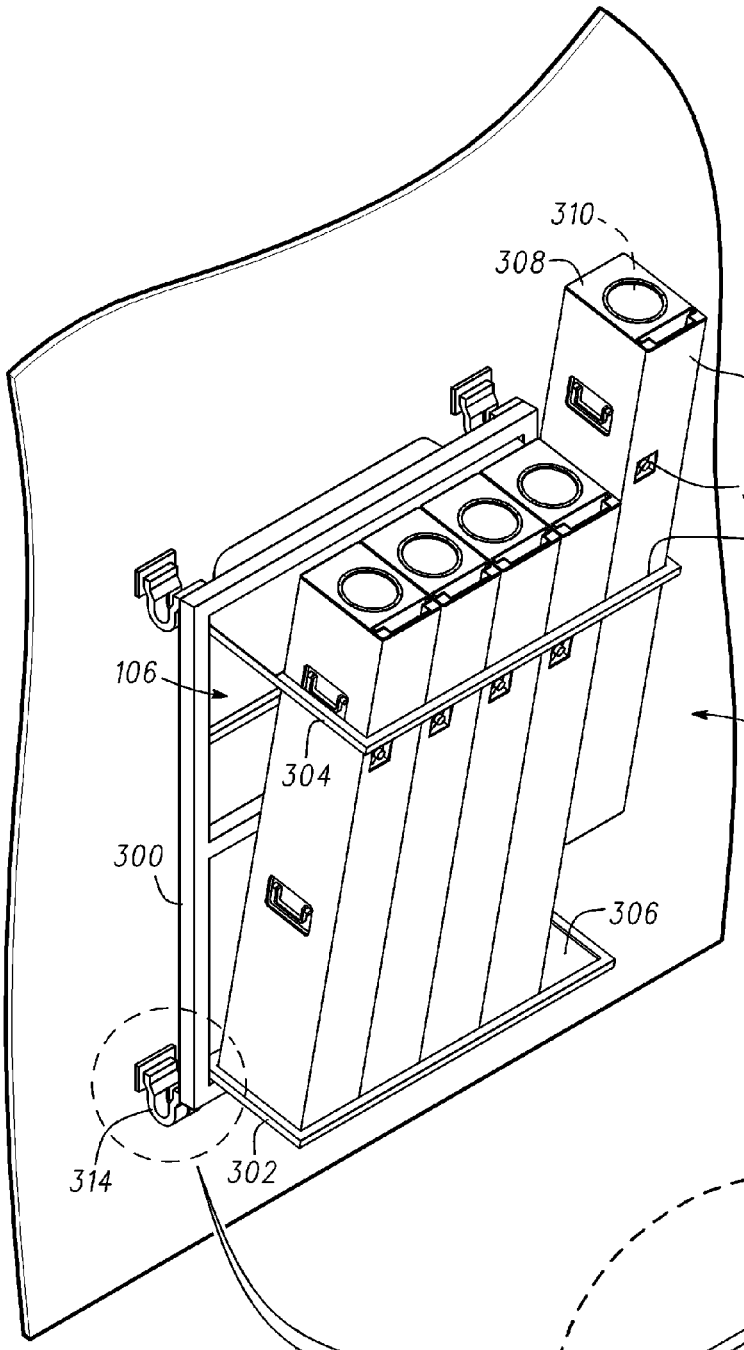
FIG. 3 is a perspective view of one example of a stowable effector launcher housing in a deployed configured with effector launchers installed.

FIG. 3 shows one example of the effector launch system 104 in detail. As shown the effector launcher housing 106 of the effector launch system 104 includes a housing panel 300. In one example, the housing panel 300 is mounted to a vehicle surface such as the vehicle surface 102 shown in FIG. 1 with one or more isolation mounts 314. As further shown in FIG. 3, receptacle brackets 302, 304 extend from the housing panel 300. Optionally, the receptacle brackets 302, 304 are movably coupled with the housing panel 300 to facilitate the transition of the effector launcher housing 106 from the deployed configuration shown in FIG. 3 to the stowed configuration (shown in FIG. 2). When deployed the receptacle brackets 302, 304 provide the effector launcher socket 306. In one example, the receptacle brackets 302, 304 provide first and second portions of the effector launcher socket 306, such as upper and lower portions of the socket.

The portion of the effector launcher socket 306 associated with the receptacle bracket 304 is positioned further from the housing panel 300 than the corresponding portion of the bracket 302. Accordingly, the effector launchers 108 are orientated at an angle relative to the vehicle surface 102 (and launch away from the vehicle 100).

In one example, the effector launcher socket 306 is sized and shaped to retain a plurality of the effector launchers 108 therein. As shown in FIG. 3 the receptacle brackets are sized to facility the slidably positioning of the effector launchers 108 within the effector launcher socket 306. In another example, the effector launcher socket 306 is subdivided into a plurality of launcher sockets each sized and shaped to receive one or more of the effector launchers 108 therein. FIG. 3 shows an example of the effector launcher housing 106 having sufficient space for up to five effector launchers 108. In other examples, the effector launcher housing 106 is sized and shaped to receive one or more effector launchers 108.

As shown in FIG. 3, the effector launchers 108 have a consistent shape and size for reception within the effector launcher sockets 306 of the effector launcher housing 106. For instance, the adapter housings 308 of the launchers 108 are each configured to retain and launch one of a variety of effectors 310 (munition effectors, UAV effectors, counter measure effectors or the like). Each of the adapter housings 308 have a consistent size and shape for reception within the effector launcher sockets 306. Accordingly an operator chooses and then installs one or more varying effector launchers 108 in the effector launcher housing 106 according to mission parameters.

The effector launchers 108 further include data and power ports 312 provided on one or more of the surfaces of the adapter housing 308 (e.g., front and back). The data and power ports 312 of each of the effector launchers 108 are coupled with corresponding interfaces of the effector launcher housing 106. The corresponding power and data interfaces of the effector launcher housing 106 are in communication with the fire control systems of the vehicle 100.

Figure 4:
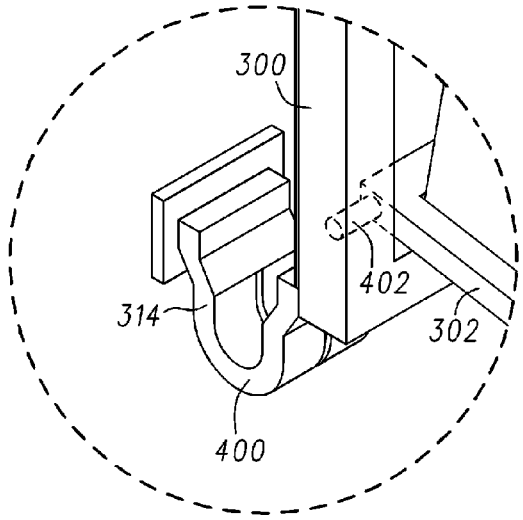
FIG. 4 is a detailed perspective view of one example of a housing panel and a receptacle bracket of the stowable effector launcher.

Referring now to FIG. 4 a detailed perspective view of one of the isolation mounts and a movable joint is provided. As shown the isolation mount 314 includes a deflecting bracket 400 extending between a portion of the isolation mount coupled with the surface of the vehicle and the housing panel 300. In one example, the deflecting bracket 400 deflects during launching of one or more of the effector launchers 108. The force and vibration transmitted from the effector launcher to the effector launcher housing 106 is absorbed by the deflecting bracket 400 to accordingly prevent or mitigate the transmission of force and vibration to the surface 102 of the vehicle 100.

As further shown in FIG. 4 one example of a movable joint 402 is shown in broken lines. In one example, the movably joint 402 includes a pivoting or rotating joint and the receptacle bracket 302 rotates relative to the housing panel 300 at the joint. In another example, the movable joint 402 includes a detent system or latching system configured to hold the receptacle bracket 302 (and similarly the receptacle bracket 304) in the deployed configuration shown in FIGS. 1 and 3. Optionally, the latching or detent system is holds the receptacle brackets 302, 304 in the stowed configuration shown in FIG. 2. In other examples, the movable joints 306 facilitate the folding of the receptacle brackets relative to the housing panel in the manner of the a collapsible frame.

Figure 6:
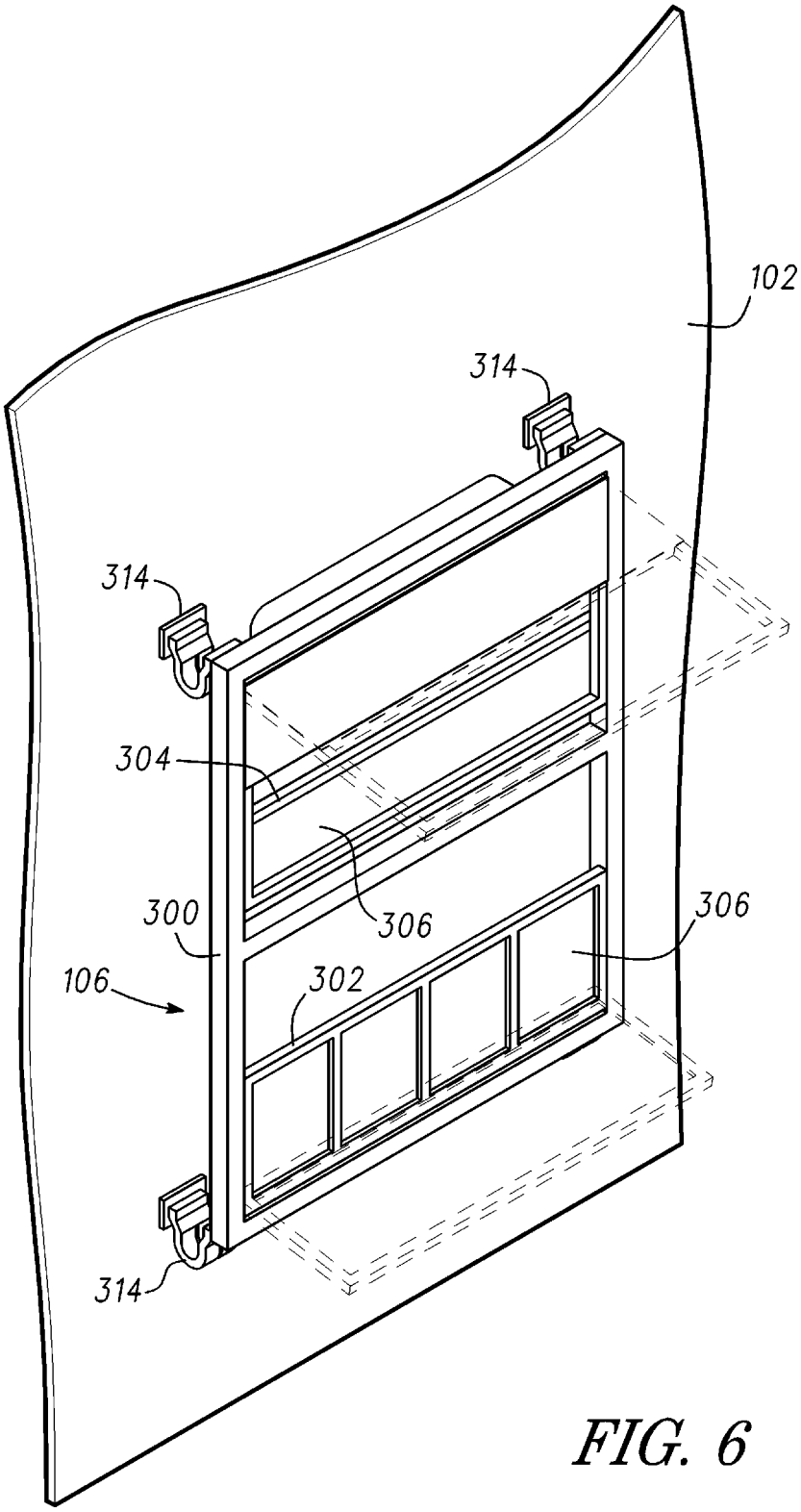
FIG. 6 is perspective view of the stowable effector launcher of FIG. 3 in a stowed configuration with the effector launchers removed.

In still other examples the receptacle brackets 302, 304 are removable from the housing panel 300 and stowable with the housing panel or on a different part of the vehicle 100. In the stowed configuration, whether the receptacle brackets 302, 304 are stowed along the housing panel 300 or removed from the panel, the effector launcher housing 106 is collapsed into a smaller configuration than when deployed. As shown in FIG. 6, in the stowed configuration, the effector launcher housing is substantially planar and flush to the surface 102 in comparison to the deployed configuration where the effector launcher housing 106 extends from the surface 102. The effector launcher housing 106 in the stowed configuration (with the effector launchers 108 removed) accordingly has a relative small space footprint on the vehicle 100 compared to the deployed configuration to allow the use of vacated space for other mission purposes including, but not limited to, storage, the personnel transport, humanitarian aid transport or the like.

Figure 5:
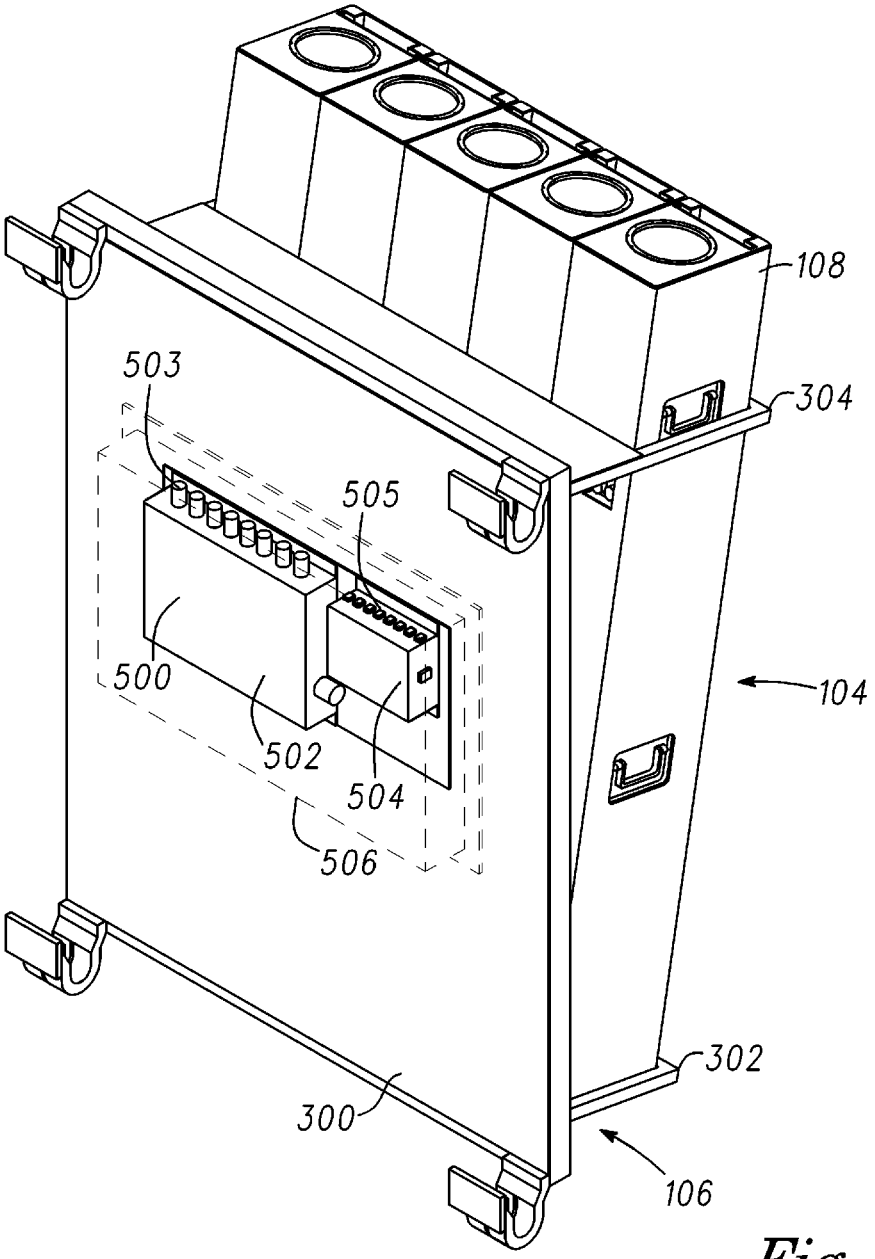
FIG. 5 is a detailed perspective view of one example of a power and data interface of the stowable effector launcher.

FIG. 5 shows another perspective view of the effector launch system 104. As shown in this perspective view the effector launch system 104 is seen from the rear with the housing panel 300 as it would appear facing the vehicle surface 102. The effector launch system 104 optionally includes a data and power interface 500 positioned along the housing panel 300. The data and power interface 500 provides for interconnection of each of the effector launchers 108 previously described herein with a fire control system of the vehicle 100. For instance the data and power interface 500 includes a number of sockets or ports to allow for cable connections with each of the effector launchers 108. As previously described and shown in FIG. 3 the effector launchers 108 include data and power ports 312. Optionally, the effector launchers include data and power ports 312 configured to operate according to other data transmission formats including, but not limited to, wireless, optical, radio frequency or the like.

As shown in FIG. 5 the data and power interface 500 includes a power board 502 and a data board 504. The power board 502 includes power sockets 503 sized and shaped to provide cable connections with the corresponding power ports of the data and power ports 312 of each of the effector launchers 108. Similarly, the data board 504 includes a plurality of data sockets 505 sized and shaped for coupling with corresponding data ports of the data and power ports 312 of the effector launchers 108. After installation of each of the effector launchers 108 within the effector launcher sockets 306 the effector launchers 108 are coupled with the fire control systems of the vehicle 100 by way of connections through the data and power interface 500 and the data and power ports 312. After use of the effector launchers (launching) or selective removal and installation of differing effector launchers 108 (for changed mission objectives) the cable connections between the data and power interface 500 are reconnected to the newly installed effector launchers 108.

In still another example, the housing panel 300 optionally includes a sealed interface housing 506. In one example the sealed interface housing 506 (shown in broken lines in FIG. 5) provides a sealed protective housing to the data and power interface 500. In some examples the vehicle 100 is used in saltwater or other rugged environments and accordingly the sensitive components of the data and power interface 500 are protected by the sealed interface housing 506. In one example the sealed interface housing 506 provides socket access to each of the power sockets 503 and data sockets 505 for connection to the corresponding data and power ports 312 of the effector launchers 108. In still other examples, the data and power interface 500 is opened where access is needed to the power and data sockets 503, 505. After use of the effector launchers 108 or stowing of the effector launchers 108 the data and power interface 500 is closed, for instance by closing the sealed interface housing 506 to correspondingly protect the data and power interface 500 therein.

FIG. 6 shows a perspective view of the effector launcher housing 106 in the stowed configuration. As shown the receptacle brackets 302, 304 are folded into the stowed configuration. In the example shown in FIG. 6 the receptacle brackets 302, 304 are folded into and within the borders of the housing panel 300. In another example the receptacle brackets 302, 304 are folded on top of the housing panel 300 or around the edges of the housing panel according to the dimensions of the receptacle brackets 302. As further shown in FIG. 6 the receptacle brackets are shown in broken lines in the corresponding deployed configuration previously shown in FIG. 3. As shown in the deployed configuration the receptacle brackets 302, 304 extend away from the housing panel for instance to provide an angled mounting for the effector launchers 108 during operational use of the effector launch system 104 previously shown in FIG. 3.

When operation of the effector launchers 108 is not anticipated the effector launchers 108 are removed, for instance by sliding out of the receptacle brackets 302, 304 and the brackets are then folded into the orientation shown in FIG. 6. As shown the effector launcher housing 106 is provided in a collapsed configuration where the effector launcher housing 106 lays adjacent to and along the vehicle surface such as the vehicle surface 102. In this configuration the effector launcher housing 106 is tightly positioned close to the vehicle surface 102 to allow for the use of the vacated space on the vehicle 100 for any of a number of other uses as described herein (e.g., carrying of personnel, humanitarian aid, storage or the like). When operational needs dictate the use of effector launchers 108 again the receptacle brackets 302 are moved from the stowed configuration provided in FIG. 6 into the deployed configuration shown in broken lines (and shown in FIG. 3). Effector launchers 108 are selected according to the mission needs and are installed within the receptacle brackets 302, 304 for instance within the effector launcher sockets 306. The launchers are thereafter coupled with the data and power interface 500 with the data and power ports 312.

Figure 7:
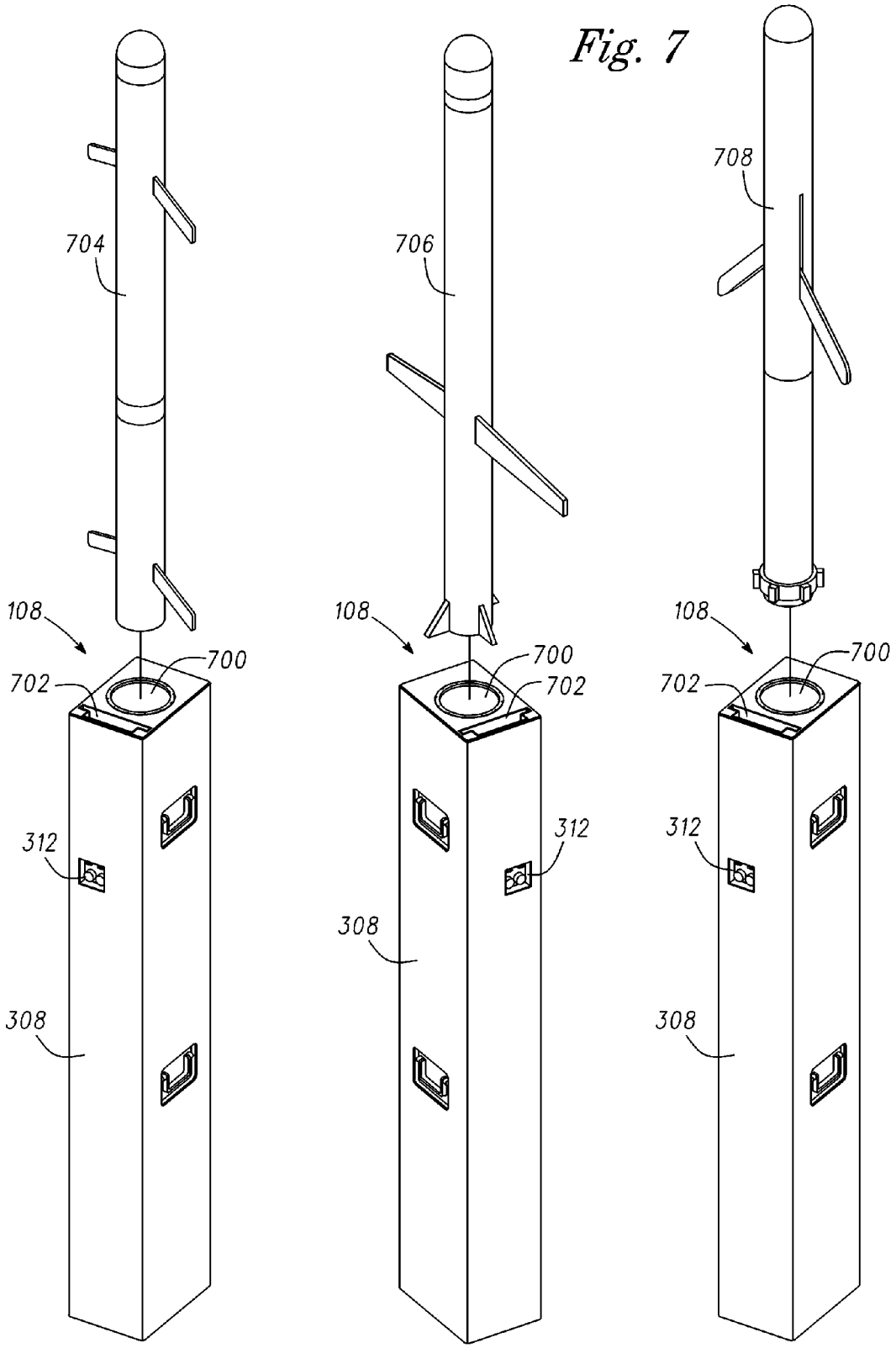
FIG. 7 is an exploded view of X examples of effector launchers and effectors configured for loading within the launchers.

FIG. 7 shows three examples of effector launchers 108. As previously described the effector launchers 108 include a variety of selectable effectors 310 configured for reception within the launchers 108. A variety of different effector types with different capabilities may be provided in a single effector launcher housing 106 to diversify and provide additional operational capability to a vehicle such as the vehicle 100 including the plurality of effector launchers 108 and the effector launching housing 106.

As shown in FIG. 7 each of the adapter housings 308 have the consistent shape and size previously shown and described in FIG. 3. For instance, the adapter housings 308 have a rectangular cross sectional footprint and a consistent length. Optionally, each of the adapter housings 308 is slidable into the installed configuration shown in FIG. 3. Each of the adapter housings 308 includes a data and power port 312 to couple the adapter housings 308 with a corresponding fire control system of the vehicle 100, for instance through the data and power interface 500 previously shown and described in FIG. 5.

The adapter housings 308 further include launching recesses 700 sized and shaped to retain and release the respective effectors 704, 706, 708 shown in FIG. 7. Additionally, in another example the adapter housings 308 include corresponding exhaust vents 702 (exhaust management). In one example the exhaust vents 702 provide a redirected flow of exhaust from the effector 704, 706, 708 to ensure the exhaust is directed away from the vehicle 100. The adapter housings 308 also provide a data link or interface between the data and power port 312 to the effectors 704, 706, 708 to facilitate the flow of target information, location information of the effector prior to launch, and launch instructions or the like.

Referring again to FIG. 7 each of the effectors 704, 706, 708 has a different configuration from the others. For instance each of the effectors 704, 706, 708 carry different payloads, have different ranges, differing sensor capabilities or the like. As previously described herein the effectors 704, 706, 708 for the effector launchers 108 may provide varying mission capabilities including, but not limited to, for instance the provision of counter measures, delivery of an unmanned air vehicle (UAV), delivery of munitions, flares, counter measures and the like. As shown in FIG. 7 each of the effectors 704, 706, 708 having a different configuration is otherwise received within the standardized effector launchers 108. Accordingly, each of the effectors 704, 706, 708 (as well as other similar effectors) are loaded within the standardized effector launchers 108 and subsequently loaded within the effector launcher sockets 306 of the effector launcher housing 106 on an as-needed basis. For instance, with the effector launching housing 106 shown in FIG. 3 one or more munition based effector launchers 108 are loaded with a UAV effector launcher, a counter measure effector launcher, a flare effector launcher or the like. Accordingly the vehicle 100 including the plurality of effector launchers 108 provides a corresponding plurality of capabilities for a particular mission. The effector launchers 108 are selectively replaced with differing effector launchers 108 to accordingly provide additional flexibility for the vehicle 100 in a variety of mission roles.

Figure 8:
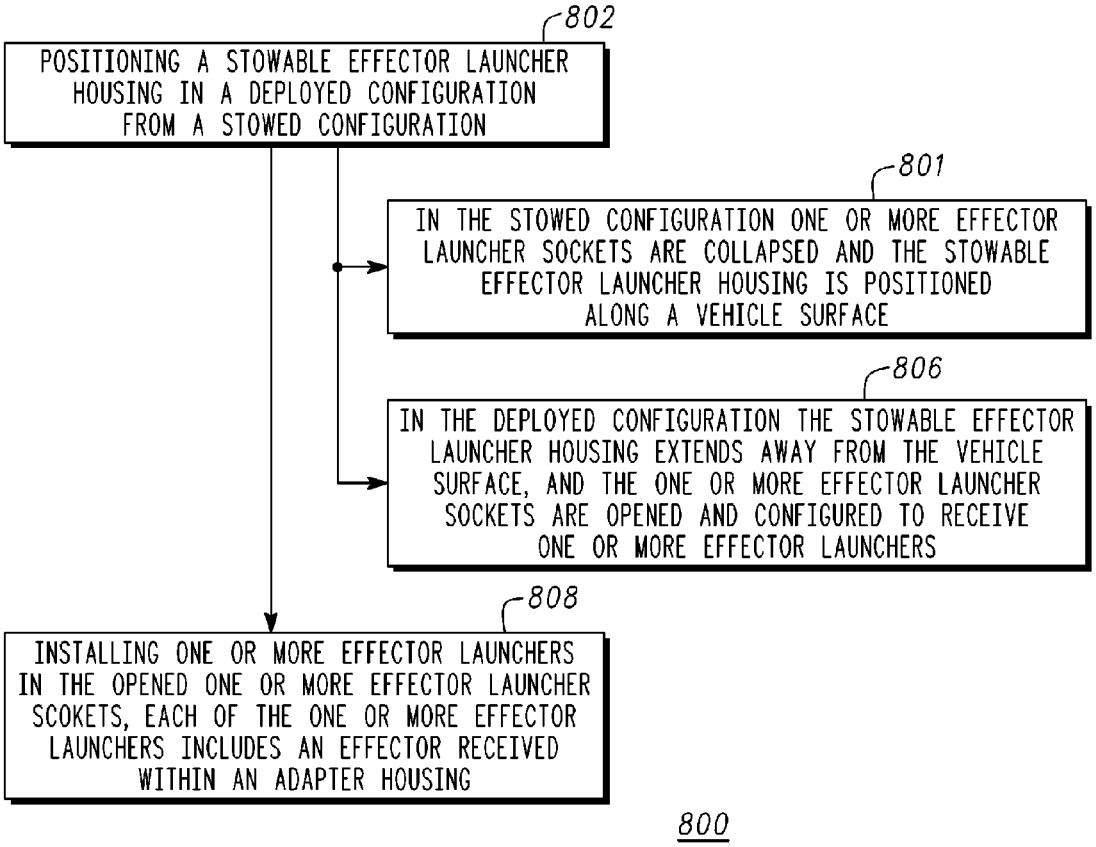
FIG. 8 is a method flow block diagram showing one example of a method of using the deployable effector launcher housing.

FIG. 8 shows one example of a method 800 for deploying a stowable effector launch system, such as the effector launch system 104 previously shown and described in FIG. 3. In describing the method 800 reference is made to one or more components, features, functions and the like described herein. Where convenient, reference is made to the components and features with reference numerals. Reference numerals provided are exemplary and are not exclusive. For instance the features, components, functions and the like described in the method 800 include, but are not limited to, the corresponding numbered elements, other corresponding features described herein (both numbered and unnumbered) as well as their equivalents. At 802, the method 800 includes positioning a stowable effector launcher housing, such as the effector launcher housing 106 shown in FIG. 3, in a deployed configuration from a stowed configuration. In one example the deployed configuration is shown in FIGS. 1 and 3 and the stowed configuration is shown in FIGS. 2 and 6. For instance, receptacle brackets 302, 304 are moved into a deployed orientation extending from the housing panel 300. As described herein, in one example movable joints 402 are used for rotation of the brackets. In another example, the receptacle brackets 302, 304 are a folding or collapsible framework. In still another example, the receptacle brackets 302, 304 are removable from the housing panel 300, and positioning includes assembling the brackets to the panel.

At 804, in the stowed configuration one or more effector launcher sockets 306 are collapsed (e.g., closed according to movement of the brackets, removal of the brackets or the like) and the stowable effector launcher housing 106 is positioned on a vehicle surface such as the vehicle surface 102 of the vehicle 100. As shown in FIG. 1 the vehicle 100 includes a marine vehicle such as a fast attack craft, patrol boat or the like. In another example, the vehicle 100 includes any of a number of marine craft including, but not limited to, larger and smaller naval or marine vessels. In still another example, the vehicle 100 includes but is not limited to a ground or air vehicle including, but not limited to, hovercraft, tanks, armored personnel carriers, cars, trucks, helicopters, VTOL aircraft, planes or the like.

At 806, in the deployed configuration the stowable effector launcher housing 106 extends away from the vehicle surface (e.g., surface 102) and the one or more effector launcher sockets 306 are opened and configured to receive one or more effector launchers 108 therein. For instance, as shown in FIG. 3 one or more effector launchers 108 are shown installed within the effector launcher sockets 306 of corresponding receptacle brackets 302, 304. One of the effector launchers 108 is shown in a partially installed configuration, for instance while it is slid into the effector launcher socket 306.

At 808 the method 800 includes installing one or more effector launchers 108 in the opened one or more effector launcher sockets 306 (for instance first and second socket portions) of the receptacle brackets 302, 304. Each of the one or more effector launchers 108 includes an effector such as the effectors 704, 706, 708 shown in FIG. 7 respectively received within an adapter housing 308 shown in FIGS. 3 and 7. That is to say, one or more of the same or varying effector launchers 108 are installed in the same effector launcher housing 106 to provide a variety of capabilities to the vehicle 100. For instance and as previously stated herein at least some of the effector launchers 108 as shown in FIG. 3 include munitions based effectors, such as missile warheads or the like while other effector launchers 108 include counter measure launching systems, UAV launching systems, flare launching systems or the like.

Several options for the method 800 follow. In one example the method 800 includes positioning the stowable effector launcher housing 106 in the stowed configuration from the deployed configuration (as shown in FIGS. 1 and 2 and FIGS. 3 and 6). Positioning the stowable effector launcher housing 106 between the deployed and stowed configurations includes removing the one or more effector launchers 108 from the opened one or more effector launcher sockets 306 and then collapsing the one or more effector launcher sockets 306. In one example collapsing the effector launcher sockets 306 includes folding the receptacle brackets 302, 304 relative to the housing panel 300 as shown in FIG. 3. As described herein, the receptacle brackets 302, 304 include corresponding rotatable joints 402 (see FIG. 4). In another example, the receptacle brackets 302, 304 are formed as a framework that is collapsible, for instance in the manner of a telescoping or scissors-like configuration relative to the housing panel 300. In still another example, the receptacle brackets 302, 304 are removed from the housing panel 300 thereby leaving the housing panel in a unitary configuration coupled along the vehicle surface 102. In each of these stowed configurations the receptacle brackets 302, 304 including the corresponding portions of the effector launcher sockets 306 are closed by being stowed along the housing panel 300 or by physical removal from the housing panel 300.

In another example, opening the one or more effector launcher sockets 306 includes rotating the one or more receptacle brackets 302, 304 from a position along the housing panel 300 of the stowable effector launcher housing 106. For instance as previously described herein in one example the receptacle brackets 302, 304 optionally include rotatable joints 402. In one example the method 800 includes rotating the receptacle brackets 302, 304 with the rotatable joints 402 to thereby position the receptacle brackets 302, 304 in the deployed position for instance shown in FIG. 3. In another example rotation of the one or more receptacle brackets to the deployed configuration includes the operation of one or more retaining features (e.g., latches, detents or the like) to hold the receptacle brackets 302, 304 in the deployed configuration.

In the deployed configuration installing the one or more effector launchers 108 in the opened one or more effector launcher sockets 306 includes in an example sliding the one or more effector launchers such as the adapter housings 308 into a first socket portion of a first receptacle bracket such as the receptacle bracket 304 and then sliding the effector launchers 108 into a second socket portion of a second receptacle bracket such as the receptacle bracket 302. In another example, the effector launcher sockets 306 include partitioned launcher sockets to thereby provide separate retention of each of the effector launchers 108 for instance in a dedicated recess for each of the effector launchers 108. For instance the receptacle brackets 302, 304 include partitioning members extending across the corresponding portions of the effector launcher sockets 306 to allow for individual loading and retention of effector launchers 108 in one or more bays or locations within the receptacle brackets 302, 304. This configuration prevents sliding of the effector launchers in the brackets where a full load of effects is not present.

In still another example, the method 800 includes coupling the installed one or more effector launchers 108 with a data and power interface 500 of the stowable effector launch housing 106. For instance, each of the effector launchers 108 includes a data and power port 312. A data and power cable is coupled with the effector launchers 108 at the ports 312 and correspondingly coupled with the data and power interface 500 for instance power sockets 503 and data sockets 505, respectively.

Optionally, the method 800 includes selecting one or more effector launchers 108 including selecting a first effector launcher, such as an effector launcher having one of the effectors 704, 706, 708 shown in FIG. 7, and selecting at least a second effector launcher different from the first effector launcher. For instance, the second effector launcher includes one or more of differing effectors of the effectors 704, 706, 708 shown in FIG. 7. The one or more effector launchers 108 including the varying first and second effectors therein are installed in the one or more effector launcher sockets 306 of the effector launcher housing 106. Each of the first and second effector launchers 108 is operable within the stowable effector launcher housing 106. For instance, data and power cables are coupled with the data and power ports 312 of each of the effector launchers 108 to the data and power interface 500 of the effector launcher housing 106. Accordingly, the fire control systems of the vehicle 100 are thereby in communication with the effector launch system 104 (including the housing 106 as well as the effector launchers 108 therein) to allow for selection of and launching of the desired effector 704, 706, 708. In still another example the method 800 includes removing a first effector launcher 108, for instance including the first effector, from the one or more effector launcher sockets 306 of the effector launcher housing 106. A second effector launcher (e.g., including a differing effector launcher or a replacement of the first effector launcher) is installed in the one or more effector launcher sockets in place of the first effector launcher. For instance, as an effector launcher 108 is used or a differing mission need is assessed that effector launcher 108 is removed and replaced with an effector launcher 108 more suited to the particular mission objective.

Various Notes & Examples

Example 1 can include an apparatus such as can include an effector launch system comprising: a stowable effector launcher housing including: a housing panel configured for coupling with a vehicle, and one or more receptacle brackets movably coupled with the housing panel, the one or more receptacle brackets including one or more effector launcher sockets; one or more effector launchers, each effector launcher includes an effector received within an adapter housing; and wherein the stowable effector launcher housing is movable between a deployed configuration and a stowed configuration: in the deployed configuration the one or more receptacle brackets extend from the housing panel and the one or more effector launchers are received within the one or more effector launcher sockets, and in the stowed configuration the one or more effector launchers are removed from the one or more effector launcher sockets and the one or more receptacle brackets are stowed along the housing panel.

Example 2 can include, or can optionally be combined with the subject matter of Example 1, to optionally include wherein in the stowed configuration the one or more effector launcher sockets are collapsed.

Example 3 can include, or can optionally be combined with the subject matter of one or any combination of Examples 1 or 2 to optionally include wherein in the stowed configuration, the one or more receptacle brackets are substantially flush with the housing panel.

Example 4 can include, or can optionally be combined with the subject matter of one or any combination of Examples 1 through 3 to optionally include wherein the stowable effector launcher housing is configured for coupling with a vehicle surface, and in the stowed configuration the stowable effector launcher housing is parallel and adjacent to the vehicle surface.

Example 5 can include, or can optionally be combined with the subject matter of one or any combination of Examples 1-4 optionally to include a data and power interface coupled with the housing panel, the data and power interface in communication with the one or more effector launchers.

Example 6 can include, or can optionally be combined with the subject matter of Examples 1-5 to optionally include wherein the data and power interface is within a sealed interface housing.

Example 7 can include, or can optionally be combined with the subject matter of Examples 1-6 to optionally include one more isolation mounts coupled with the housing panel and configured to couple with a vehicle, the isolation mounts are configured to isolate the vehicle from force and vibration generated in the effector launch system.

Example 8 can include, or can optionally be combined with the subject matter of Examples 1-7 to optionally include wherein one or more receptacle brackets rotate between the deployed and stowed configurations at rotatable joints.

Example 9 can include, or can optionally be combined with the subject matter of Examples 1-8 to optionally include wherein the one or more receptacle brackets include retaining features configured to hold the one or more receptacle brackets in at least the stowed configuration.

Example 10 can include, or can optionally be combined with the subject matter of Examples 1-9 to optionally include wherein the one or more effector launcher sockets is configured for sliding reception of the one or more effector launchers.

Example 11 can include, or can optionally be combined with the subject matter of Examples 1-10 to optionally include wherein the adapter housing of each of the one or more effector launchers includes a recess for the effector, exhaust management venting, and at least one data interface extending from power and data sockets on the adapter housing to the effector.

Example 12 can include, or can optionally be combined with the subject matter of Examples 1-11 to optionally include a stowable effector launcher housing comprising: a housing panel configured for coupling with a vehicle, and one or more receptacle brackets movably coupled with the housing panel, the one or more receptacle brackets include one or more effector launcher sockets configured to slidably receive one or more effector launchers; a data and power interface coupled with the housing panel, the data and power interface is configured for coupling with one or more effector launchers; and wherein the stowable effector launcher is movable between a deployed configuration and a stowed configuration: in the deployed configuration the one or more receptacle brackets extend from the housing panel, and the one or more effector launcher sockets are configured to slidably receive the one or more effector launchers, and in the stowed configuration the one or more receptacle brackets are stowed along the housing panel and the one or more effector launcher sockets are collapsed.

Example 13 can include, or can optionally be combined with the subject matter of Examples 1-12 to optionally include wherein while coupled with a vehicle in the deployed configuration the one or more receptacle brackets extend away from the housing panel and a vehicle surface of the vehicle, and in the stowed configuration the one or more receptacle brackets and the housing panel are adjacent to and extend along the vehicle surface.

Example 14 can include, or can optionally be combined with the subject matter of Examples 1-13 to optionally include wherein in the stowed configuration the one or more receptacle brackets are substantially flush with the housing panel.

Example 15 can include, or can optionally be combined with the subject matter of Examples 1-14 to optionally include wherein the data and power interface is within a sealed interface housing.

Example 16 can include, or can optionally be combined with the subject matter of Examples 1-15 to optionally include one more isolation mounts coupled with the housing panel and configured to couple with a vehicle, the isolation mounts are configured to isolate the vehicle from force and vibration generated in the effector launch system.

Example 17 can include, or can optionally be combined with the subject matter of Examples 1-16 to optionally include wherein the one or more effector launcher sockets includes a single effector launcher socket configured for sliding reception of a plurality of effector launchers.

Example 18 can include, or can optionally be combined with the subject matter of Examples 1-17 to optionally include wherein the one or more effector launcher sockets includes a plurality of separated effector launcher sockets each configured for sliding reception of a corresponding effector launcher.

Example 19 can include, or can optionally be combined with the subject matter of Examples 1-18 to optionally include wherein the one or more receptacle brackets include: a first receptacle bracket including a first socket portion of the one or more effector launcher sockets, a second receptacle bracket including a second socket portion of the one or more effector launcher sockets, the second receptacle bracket spaced from the first receptacle bracket, and wherein the first socket portion is spaced further away from the housing panel than the second socket portion in the deployed configuration.

Example 20 can include, or can optionally be combined with the subject matter of Examples 1-19 to optionally include a method of deploying a stowable effector launch system comprising: positioning a stowable effector launcher housing in a deployed configuration from a stowed configuration: in the stowed configuration one or more effector launcher sockets are collapsed and the stowable effector launcher housing is positioned along a vehicle surface, and in the deployed configuration the stowable effector launcher housing extends away from the vehicle surface, and the one or more effector launcher sockets are opened and configured to receive one or more effector launchers; and installing one or more effector launchers in the opened one or more effector launcher sockets, each of the one or more effector launchers includes an effector received within an adapter housing.

Example 21 can include, or can optionally be combined with the subject matter of Examples 1-20 to optionally include positioning the stowable effector launcher housing in the stowed configuration from the deployed configuration including: removing the one or more effector launchers from the opened one or more effector launcher sockets; and collapsing the one or more effector launcher sockets.

Example 22 can include, or can optionally be combined with the subject matter of Examples 1-21 to optionally include wherein opening the one or more effector launcher sockets includes rotating one or more receptacle brackets from a housing panel of the stowable effector launcher housing.

Example 23 can include, or can optionally be combined with the subject matter of Examples 1-22 to optionally include wherein installing the one or more effector launchers in the opened one or more effector launcher sockets includes: sliding the one or more effector launchers into a first socket portion of a first receptacle bracket, and sliding the one or more effector launchers into a second socket portion of a second receptacle bracket.

Example 24 can include, or can optionally be combined with the subject matter of Examples 1-23 to optionally include coupling the installed one or more effector launchers with a data and power interface of the stowable effector launch housing.

Example 25 can include, or can optionally be combined with the subject matter of Examples 1-24 to optionally include selecting the one or more effector launchers including: selecting a first effector launcher, selecting a second effector launcher, the second effector launcher different from the first effector launcher; and installing the one or more effector launchers including the first and second effector launchers in the opened one or more effector launcher sockets, wherein each of the first and second effector launchers is operable within the stowable effector launcher housing.

Example 26 can include, or can optionally be combined with the subject matter of Examples 1-25 to optionally include removing a first effector launcher from the one or more effector launcher sockets; and installing a second effector launcher in the one or more effector launcher sockets in place of the first effector launcher.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

What is claimed is:

1. An effector launch system comprising:

a stowable effector launcher housing including:

a housing panel configured for coupling with a vehicle, and one or more receptacle brackets movably coupled with the housing panel, the one or more receptacle brackets including one or more effector launcher sockets;

one or more effector launchers, each effector launcher includes an effector received within an adapter housing; and wherein the stowable effector launcher housing is movable between a deployed configuration and a stowed configuration:

in the deployed configuration the one or more receptacle brackets extend from the housing panel and the one or more effector launchers are received within the one or more effector launcher sockets, and in the stowed configuration the one or more effector launchers are removed from the one or more effector launcher sockets, the one or more effector launcher sockets are collapsed, and the one or more receptacle brackets are stowed on an exterior of the housing panel.

2. The effector launch system of claim 1, wherein in the stowed configuration, the one or more receptacle brackets are substantially flush with the housing panel.

3. The effector launch system of claim 1, wherein the stowable effector launcher housing is configured for coupling with a vehicle surface, and in the stowed configuration the stowable effector launcher housing is parallel and adjacent to the vehicle surface.

4. The effector launch system of claim 1 comprising a data and power interface coupled with the housing panel, the data and power interface in communication with the one or more effector launchers.

5. The effector launch system of claim 4, wherein the data and power interface is within a sealed interface housing.

6. The effector launch system of claim 1 comprising one more isolation mounts coupled with the housing panel and configured to couple with a vehicle, the isolation mounts are configured to isolate the vehicle from force and vibration generated in the effector launch system.

7. The effector launch system of claim 1, wherein one or more receptacle brackets rotate between the deployed and stowed configurations at rotatable joints.

8. The effector launch system of claim 1, wherein the one or more receptacle brackets include retaining features configured to hold the one or more receptacle brackets in at least the stowed configuration.

9. The effector launch system of claim 1, wherein the one or more effector launcher sockets is configured for sliding reception of the one or more effector launchers.

10. The effector launch system of claim 1, wherein the adapter housing of each of the one or more effector launchers includes a recess for the effector, exhaust management venting, and at least one data interface extending from power and data sockets on the adapter housing to the effector.

11. A stowable effector launcher housing comprising:

a housing panel configured for coupling with a vehicle, and one or more receptacle brackets movably coupled with the housing panel, the one or more receptacle brackets include one or more effector launcher sockets configured to slidably receive one or more effector launchers;

a data and power interface coupled with the housing panel, the data and power interface is configured for coupling with the one or more effector launchers; and wherein the stowable effector launcher is movable between a deployed configuration and a stowed configuration:

in the deployed configuration the one or more receptacle brackets extend from the housing panel, and the one or more effector launcher sockets of the one or more receptacle brackets are configured to slidably receive the one or more effector launchers, and in the stowed configuration the one or more receptacle brackets are stowed on an exterior of the housing panel and the one or more effector launcher sockets are collapsed.

12. The stowable effector launcher housing of claim 11, wherein while coupled with a vehicle in the deployed configuration the one or more receptacle brackets extend away from the housing panel and a vehicle surface of the vehicle, and in the stowed configuration the one or more receptacle brackets and the housing panel are adjacent to and extend along the vehicle surface.

13. The stowable effector launcher housing of claim 11, wherein in the stowed configuration the one or more receptacle brackets are substantially flush with the housing panel.

14. The stowable effector launcher housing of claim 12, wherein the data and power interface is within a sealed interface housing.

15. The stowable effector launcher housing of claim 11 comprising one more isolation mounts coupled with the housing panel and configured to couple with a vehicle, the isolation mounts are configured to isolate the vehicle from force and vibration generated in the effector launch system.

16. The stowable effector launcher housing of claim 11, wherein the one or more effector launcher sockets includes a single effector launcher socket configured for sliding reception of a plurality of effector launchers.

17. The stowable effector launcher housing of claim 11, wherein the one or more effector launcher sockets includes a plurality of separated effector launcher sockets each configured for sliding reception of a corresponding effector launcher.

18. The stowable effector launcher housing of claim 11, wherein the one or more receptacle brackets include:

a first receptacle bracket including a first socket portion of the one or more effector launcher sockets, a second receptacle bracket including a second socket portion of the one or more effector launcher sockets, the second receptacle bracket spaced from the first receptacle bracket, and wherein the first socket portion is spaced further away from the housing panel than the second socket portion in the deployed configuration.

19. A method of deploying a stowable effector launch system comprising:

positioning a stowable effector launcher housing in a deployed configuration from a stowed configuration:

in the stowed configuration one or more effector launcher sockets are collapsed and the stowable effector launcher housing is positioned along a vehicle exterior surface, and in the deployed configuration the stowable effector launcher housing extends away from the vehicle exterior surface, and the one or more effector launcher sockets are opened and configured to receive one or more effector launchers; and installing one or more effector launchers in the opened one or more effector launcher sockets, each of the one or more effector launchers includes an effector received within an adapter housing.

20. The method of claim 19, comprising positioning the stowable effector launcher housing in the stowed configuration from the deployed configuration including:

removing the one or more effector launchers from the opened one or more effector launcher sockets; and collapsing the one or more effector launcher sockets.

21. The method of claim 19, wherein opening the one or more effector launcher sockets includes rotating one or more receptacle brackets from a housing panel of the stowable effector launcher housing.

22. The method of claim 19, wherein installing the one or more effector launchers in the opened one or more effector launcher sockets includes:

sliding the one or more effector launchers into a first socket portion of a first receptacle bracket, and sliding the one or more effector launchers into a second socket portion of a second receptacle bracket.

23. The method of claim 19 comprising coupling the installed one or more effector launchers with a data and power interface of the stowable effector launch housing.

24. The method of claim 19 comprising:

selecting the one or more effector launchers including:

selecting a first effector launcher, selecting a second effector launcher, the second effector launcher different from the first effector launcher; and installing the one or more effector launchers including the first and second effector launchers in the opened one or more effector launcher sockets, wherein each of the first and second effector launchers is operable within the stowable effector launcher housing.

25. The method of claim 19 comprising:

removing a first effector launcher from the one or more effector launcher sockets; and installing a second effector launcher in the one or more effector launcher sockets in place of the first effector launcher.

26. The effector launch system of claim 1, wherein the one or more receptacle brackets are folded along the housing panel in the stowed configuration.

27. The effector launch system of claim 1, wherein at least the one or more receptacle brackets are a collapsible frame.

28. The stowable effector launch system of claim 11, wherein the one or more receptacle brackets are folded along the housing panel in the stowed configuration.

29. The stowable effector launch system of claim 11, wherein at least the one or more receptacle brackets are a collapsible frame.

30. The method of claim 19, wherein positioning the stowable effector launcher includes unfolding one or more receptacle brackets from the housing panel to open the one or more effector launcher sockets.

* * * * *